US008297833B2

(12) United States Patent
Schmiedchen

(10) Patent No.: US 8,297,833 B2
(45) Date of Patent: Oct. 30, 2012

(54) ASSEMBLY FOR SECURING THE OUTER END OF THE BALANCE-SPRING OF A SPRUNG BALANCE DEVICE FOR A TIMEPIECE

(75) Inventor: Christian Schmiedchen, Reichstadt (DE)

(73) Assignee: GLASHÜTTER Uhrenbetrieb GmbH, Allemagne (DE)

( * ) Notice: Subject to any disclaimer, the term of this patent is extended or adjusted under 35 U.S.C. 154(b) by 262 days.

(21) Appl. No.: 12/854,689

(22) Filed: Aug. 11, 2010

(65) Prior Publication Data

US 2011/0051565 A1 Mar. 3, 2011

(30) Foreign Application Priority Data

Aug. 25, 2009 (EP) ..... 09168602

(51) Int. Cl.
*G04B 17/04* (2006.01)

(52) U.S. Cl. ..... 368/178; 368/170

(58) Field of Classification Search ..... 368/175–178, 368/170

See application file for complete search history.

(56) References Cited

U.S. PATENT DOCUMENTS

| | | | | | |
|---|---|---|---|---|---|
| 221,180 | A | * | 11/1879 | Monday et al. | 368/178 |
| 362,559 | A | * | 5/1887 | Weland | 368/176 |
| 2,698,509 | A | * | 1/1955 | Van Valkenburgh et al. | 368/175 |
| 2,982,086 | A | * | 5/1961 | Loretan | 368/172 |
| 3,154,912 | A | * | 11/1964 | Pinkas | 368/176 |
| 3,241,307 | A | * | 3/1966 | Dickerman | 368/176 |
| 3,579,977 | A | * | 5/1971 | Meylan-Rochat | 368/173 |
| 3,630,017 | A | | 12/1971 | Marti | |
| 7,059,764 | B2 | * | 6/2006 | Hintze et al. | 368/127 |

FOREIGN PATENT DOCUMENTS

| | | | |
|---|---|---|---|
| CH | 401 836 | A | 6/1965 |
| CH | 1/70 | A | 11/1971 |
| EP | 1 199 615 | A1 | 4/2002 |
| FR | 1 313 030 | A | 12/1962 |
| FR | 2 070 901 | A1 | 9/1971 |
| JP | 52-082453 | A | 7/1977 |

* cited by examiner

*Primary Examiner* — Sean Kayes

(74) *Attorney, Agent, or Firm* — Sughrue Mion, PLLC

(57) ABSTRACT

Assembly for securing the outer end of the balance-spring (1) of a sprung balance device for a timepiece that includes a balance-spring stud holder (2) for housing a balance-spring stud (10), against which the balance-spring (1) can be locked, a screw (11) for locking the stud, for securing the balance-spring (1) by insertion between the stud (10) and a back face (7), the locking screw (11) including a tip (15) in the extension of the threaded body (12) at the opposite end to the screw head, and the stud (10) including a housing (16) in which the tip (15) can be inserted. The corresponding watch and method of securing the outer end of the balance-spring are also provided.

7 Claims, 1 Drawing Sheet

ASSEMBLY FOR SECURING THE OUTER END OF THE BALANCE-SPRING OF A SPRUNG BALANCE DEVICE FOR A TIMEPIECE

This application claims priority from European Patent Application No. 09168602.2 filed Aug. 25, 2009, the entire disclosure of which is incorporated herein by reference.

FIELD OF THE INVENTION

The invention concerns an assembly for securing the outer end of the balance-spring of a sprung balance device for a timepiece. It also concerns a corresponding sprung balance device for a timepiece, and the associated timepiece.

STATE OF THE PRIOR ART

In a mechanical watch, it is usual practice to use a regulating member comprising a sprung balance device. Conventionally, the inner end of the balance-spring is fixed to a collet on the pivoting balance staff. In order to fix and position the outer end of the balance-spring, it is known to use a balance-spring stud holder housing a balance-spring stud, in association with a locking screw for locking the balance-spring stud against the portion of the balance-spring engaged in the stud holder. In an assembly of this type, the stud holder is conventionally secured to a balance-cock that is also used for securing one of the ends of the balance staff. In practice, during assembly and/or adjustment, it is difficult to handle these various elements, since access is restricted and the parts are of very small dimensions. Moreover, with this type of configuration, it is common for the balance-spring or stud holder locking screw to come off and/or be lost when it is handled, such as during adjustment of the active length of the balance-spring.

SUMMARY OF THE INVENTION

The invention proposes various means for avoiding this type of drawback, particularly in order to make it easier to position the balance-spring and adjust its active length and thus to minimise the difficult handling that has to be performed.

The invention provides, first of all, an assembly for securing the outer end of the balance-spring of a sprung balance device for a timepiece that includes:

- a balance-spring stud holder, which is fixed to a balance-cock and positioned so as to allow the outer end of the balance-spring to be secured in a channel next to the stud holder, and which is devised for housing a balance-spring stud against which the balance-spring can be locked;
- a screw for locking the balance-spring stud, which comprises a threaded body for assembly inside an inner thread of the stud holder that opens onto the channel and which pushes the balance-spring stud towards the back face of the channel and allows the balance-spring to be secured by insertion between the stud and said back face of the channel. According to the invention, the locking screw includes a tip in the extension of the threaded body at the opposite end to the screw head, and the balance-spring stud has a housing into which the tip can be inserted.

This device makes it easier to position and adjust the active length of the balance-spring. This ease of handling also allows the active length to be more finely adjusted.

The invention also provides a sprung balance device for a timepiece that includes:

- a balance-spring capable of generating an oscillating movement in a balance that is pivotably mounted on a balance staff;
- a balance-cock used as a support for one of the ends of the balance staff;
- a collet fixed to the balance staff and enabling the inner end of the balance-spring to be secured;
- a balance-spring stud holder, secured to the balance-cock, positioned to enable the outer end of the balance-spring to be fixed in a channel in the balance-cock, said stud holder being devised to house a stud against which the balance-spring can be locked;
- a screw for locking the balance-spring stud, which comprises a threaded body for assembly inside an inner thread of the stud holder that opens onto the channel and which pushes the balance-spring stud towards the back face of the channel and allows the balance-spring to be secured by insertion between the stud and said back face of the channel.

According to the invention, the locking screw has a tip in the extension of the threaded body, at the opposite end to the screw head, and the stud has a housing into which the tip can be inserted.

The stud holder thread is preferably oriented along an approximately radial axis relative to the axis of the collet, and made on the side furthest from the channel relative to the collet axis, the back face of the channel being approximately opposite the thread.

According to another advantageous embodiment, the channel for securing the balance-spring is convex, with a centre of curvature that approximately matches the balance-spring axis. Owing to this feature, the radii of curvature of the portion of balance-spring to be secured and of the channel are approximately matching, for easier and more precise assembly.

In a variant, the stud is has an anti-friction pad arranged on the surface of the stud that cooperates with the balance-spring. The presence of this element makes the longitudinal sliding and adjustment of the balance-spring easier.

The invention also provides a watch that includes a securing assembly as presented above.

The invention also provides a method of securing the peripheral end of a balance-spring in a timepiece sprung balance device that includes a balance-spring stud holder, secured to a balance-cock, said balance-cock being provided, on the one hand, with a channel devised for housing a balance-spring stud and, on the other hand, with an inner thread opening onto the channel, said method including the steps of:

- arranging the balance-spring stud in the channel, a housing having previously been made in the stud,
- aligning the stud housing with the inner thread of the stud holder,
- inserting a locking screw that has a tip in the extension of the threaded body at the opposite end to the screw head, in said inner thread,
- arranging the outer end of the balance-spring in said channel, radially inside the stud,
- partially tightening the screw so as to insert the tip into the housing and to allow the end of the balance-spring to slide laterally in the channel,
- adjusting the lateral position of the outer end of the balance-spring in its fixed place so as to regulate the active length of the balance-spring, completely tightening the locking screw so as to prevent any lateral sliding of the outer end of the balance-spring in the channel.

DESCRIPTION OF THE DRAWINGS

All the embodiment details are given in the following description, completed by FIGS. 1 and 2, which are given solely as non-limiting examples, wherein identical references indicate similar elements, and in which.

DETAILED DESCRIPTION OF THE INVENTION

Figure 1:
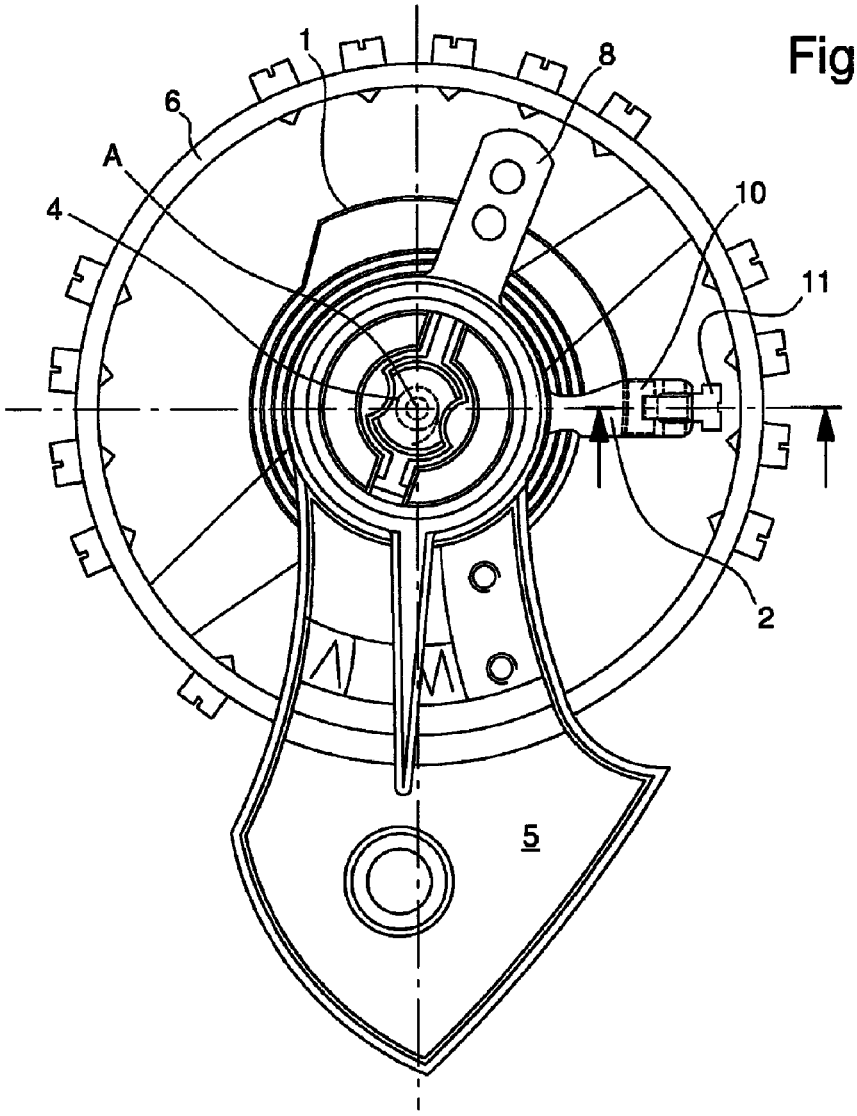
FIG. 1 is a top view showing a sprung balance device whose staff is fixed to a balance-cock on which there is a balance-spring stud holder.

FIG. 1 illustrates a view of a sprung balance device for a timepiece, showing balance-cock 5, used in a conventional manner for pivoting one of the ends of staff A of balance 6. The other end of balance staff A pivots on the bottom plate in a conventional manner. Also in a conventional manner, a collet 4 is driven onto the balance staff and allows the central portion of balance-spring 1 to be secured.

Balance-cock 5 is also used as a support for a balance-spring stud holder 2 for securing the outer end of balance-spring 1. Balance-cock 5 also carries an index 8, for cooperating with the outer coil of balance-spring 1, upstream of the end that will be secured.

Figure 2:
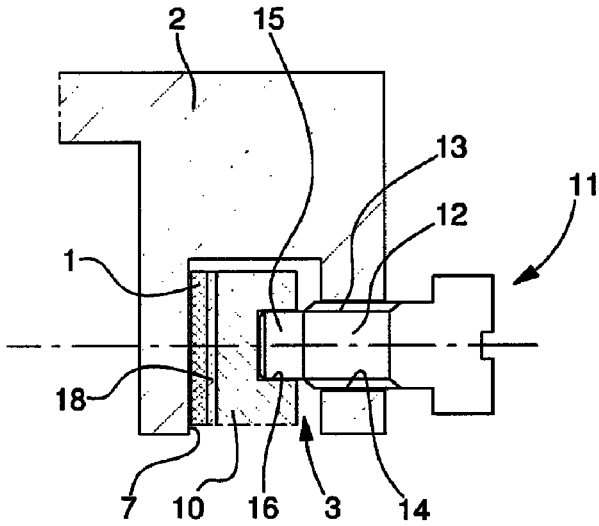
FIG. 2 is an axial cross-section of the balance-spring stud holder of FIG. 1.

In the example illustrated in FIGS. 1 and 2, balance-spring stud holder 2 is extended radially relative to balance staff 6, towards the outer coils of the balance-spring. The angular positioning of stud holder 2 is such that it allows the free outer end of balance-spring 1 to be secured. There is a convex channel 3, with a centre of curvature on balance staff 6, in stud holder 2. The convex shape of channel 3 is adapted to the profile of the area of the balance-spring to be secured, to make insertion easier. The side of channel 3 furthest from balance staff 6 is pierced by a threaded hole 14, which is radial to and passes through said side. Threaded hole 14 acts as a housing and positioning means for a locking screw 11. This screw 11 has a threaded body 12 that allows the screw to be screwed into position, as a result of the cooperation between outer thread 13 of body 12 and the corresponding inner thread of threaded hole 14.

Channel 3 is for housing at least one portion of stud 10. The stud is mobile radially and laterally in channel 3. This mobile assembly means that the end of balance-spring 1 can be locked and precisely positioned in the channel, so as to regulate the active length of the balance-spring. The shape of stud 10 is adapted to that of channel 3 and to that of balance-spring 1, so as to offer a good contact surface between the stud and the adjacent surface of the balance-spring.

Balance-spring stud 10 is held in place in channel 3 by locking and adjusting screw 11. This screw offers a dual function: it holds stud 10 in place in channel 3 before the balance-spring is locked and adjusts the rate or level at which balance-spring 1 is locked, by pushing the balance-spring against a back face 7 of channel 3. In the illustrated example, as screw 11 is screwed in, stud 10 is pushed back against back face 7, with a force that is determined by the rate of tightening/loosening of screw 11. As screw 11 is loosened, the locking force is attenuated until the balance-spring is free to slide in channel 3, depending upon the level of looseness.

Locking screw 11 achieves the function of holding stud 10 via a tip 15 provided in the extension of threaded screw body 12. A housing 16 in stud 10, on the opposite side to that which enters into contact with the balance-spring, allows tip 15 to be inserted.

Because of this connection between stud 10 and screw 11, which, via tip 15, freely enters housing 16, stud 10 can easily be held in channel 3 without any risk of being lost. Thus, the watchmaker can concentrate on positioning the outer coil of balance-spring 3 on the stud holder before the screw is screwed in, without worrying about losing the stud and/or the screw. This configuration thus allows quick and reliable assembly.

Tip 15 is a continuation of threaded body 12, the two elements preferably forming one and the same part, obtained for example by machining or any other manufacturing means that can provide an adequate level of precision for this type of mechanism.

Stud 10 illustrated in FIG. 2 carries an anti-friction joint or pad, for sliding balance-spring 1 easily when the stud is not locked against back face 7 by screw 11. It is then easy to perform precise adjustments of the fixed balance-spring position. Although not shown in the Figure, it is possible to provide a pad on the opposite side, i.e. against back face 7 instead of or as well as pad 18 arranged on the stud.

In order to implement the device of the invention, we proceed in the following manner:

- stud 10 is placed in channel 3,
- housing 15 of stud 10 is then aligned with threaded hole 14,
- the outer end of the balance-spring is arranged in said channel, radially inside the stud,
- the locking screw is inserted in said inner thread so as to allow the insertion of tip 15 in housing 16 and to allow the outer end of the balance-spring to slide laterally in channel 3,
- the lateral position of the end of the balance-spring is adjusted in its fixed place so as to regulate the active length of the balance-spring and the screw is completely tightened to prevent any lateral sliding of the end of the balance-spring in the channel.

In order to insert the outer end portion of balance-spring 1 in channel 3 or to alter its longitudinal position in the channel, locking screw 11 is turned so that stud 10 releases the space provided for the balance-spring in channel 3. The balance-spring is then set in placed and/or its longitudinal position is adjusted. In order to ensure that it is held in this position, screw 11 is turned so as to push stud 10 against the balance-spring, which is locked by back face 7, until a sufficient lock is obtained to prevent the balance-spring sliding at all in the channel.

The Figures and the above descriptions thereof illustrate the invention rather than limiting it. In particular, the invention and the various variants have just been described with reference to a particular example, which includes a stud occupying the entire width of channel 3 and a locking screw 11 with an axial position relative to stud holder 2. Nonetheless, it is evident to those skilled in the art that the invention can be extended to other embodiments, in which the stud is configured differently, and/or the locking screw is provided in a different position relative to the axis of the stud holder.

The reference signs in the claims are in no way restrictive. The verbs "comprise" and "include" do not exclude the presence of elements other than those listed in the claims. The word "one" or "a" preceding an element does not exclude the presence of a number of such elements.

What is claimed is:

1. An assembly for securing the peripheral end of the balance-spring of a sprung balance device for a timepiece, including:

a balance-spring stud holder, secured to a balance-cock and positioned to enable the outer end of the balance-spring to be fixed in a channel in the stud holder, and devised to house a stud against which the balance-spring can be locked;

a screw for locking the balance-spring stud, which comprises a threaded body for assembly inside an inner thread of the stud holder that opens onto the channel and which pushes the stud towards a back face of the channel and allows the balance-spring to be secured by insertion between the stud and said back face of the channel, wherein:

the locking screw has a tip in the extension of the threaded body, at the opposite end to the screw head; and the stud has a housing into which the tip can be inserted.

2. Securing assembly according to claim 1, wherein the inner thread of the stud holder is oriented along an approximately radial axis relative to the axis of the collet, and is made on the side furthest from the channel relative to the collet axis, the back face of the channel being approximately opposite the inner thread.

3. Securing assembly according to claim 1, wherein the balance-spring stud is provided with an anti-friction pad arranged on the surface of the stud that cooperates with the balance-spring.

4. Securing assembly according to claim 1, wherein the channel for securing the balance-spring is convex, with a centre of curvature that approximately matches the axis of the balance-spring.

5. Watch including an assembly for securing the peripheral end of the balance-spring of a sprung balance device for a timepiece, including:

a balance-spring stud holder, secured to a balance-cock and positioned to enable the outer end of the balance-spring to be fixed in a channel in the stud holder, and devised to house a stud against which the balance-spring can be locked;

a screw for locking the balance-spring stud, which comprises a threaded body for assembly inside an inner thread of the stud holder that opens onto the channel and which pushes the stud towards a back face of the channel and allows the balance-spring to be secured by insertion between the stud and said back face of the channel, wherein:

the locking screw has a tip in the extension of the threaded body, at the opposite end to the screw head; and the stud has a housing into which the tip can be inserted.

6. Sprung balance device for a timepiece including:

a balance-spring capable of generating an oscillating movement in a balance that is pivotably mounted on a balance staff;

a balance-cock used as a support for one of the ends of the balance staff;

a collet fixed the balance staff for securing the inner end of the balance-spring;

a balance-spring stud holder, secured to the balance-cock, positioned to enable the outer end of the balance-spring to be fixed in a channel on the balance-cock, said stud holder being devised to house a balance-spring stud against which the balance-spring can be locked;

a screw for locking the stud, which comprises a threaded body for assembly in the inner thread of the stud holder that opens onto the channel and which pushes the stud towards a back face of the channel and allows the balance-spring to be secured by insertion between the stud and said back face of the channel, wherein the locking screw has a tip in the extension of the threaded body, at the opposite end to the screw head;

the stud includes a housing into which the tip can be inserted.

7. Method of securing the peripheral end of a balance-spring in a sprung balance device for a timepiece including a balance-spring stud holder secured to a balance-cock and said balance-cock being provided, on the one hand, with a channel devised for housing a balance-spring stud and, on the other hand, with an inner thread that opens onto the channel, said method including the steps of:

arranging the balance-spring stud in the channel, a housing having previously been made in the stud, aligning the housing of the balance-spring stud with the inner thread of the stud holder;

inserting a locking screw that has a tip in the extension of the threaded body at the opposite end to the screw head, in said inner thread;

arranging the peripheral end of the balance-spring in said channel, radially inside the balance-spring stud;

partially tightening the screw so as to allow insertion of the tip in the housing and so as to allow the outer end of the balance-spring to slide laterally in the channel;

adjusting the lateral position of the end of the balance-spring in its fixed place so as to regulate the active length of the balance-spring;

completely tightening the screw so as to prevent any lateral sliding of the outer end of the balance-spring in the channel.

* * * * *